US005461726A

United States Patent [19]

Wade

[11] Patent Number: 5,461,726

[45] Date of Patent: Oct. 31, 1995

[54] DEVICE FOR WEARING AROUND THE NECK OF A USER

[76] Inventor: Michael P. Wade, 2817 W. End Ave., Suite 203, Nashville, Tenn. 37203

[21] Appl. No.: 309,865

[22] Filed: Sep. 21, 1994

[51] Int. Cl.[6] ..... A41D 25/00

[52] U.S. Cl. ..... 2/144; 2/145; 2/148; 2/155; 2/156

[58] Field of Search ..... 2/144, 145, 146, 2/147, 148, 149, 150, 151, 152.1, 153, 154, 155, 156, 157

[56] References Cited

U.S. PATENT DOCUMENTS

| | | | |
|---|---|---|---|
| 318,570 | 5/1885 | Lyon | 2/149 |
| 2,100,870 | 11/1937 | Petrie et al. | 2/145 |
| 2,692,387 | 10/1954 | Spaniol | 2/144 |
| 3,173,148 | 3/1965 | Horii | 2/145 |
| 3,187,396 | 6/1965 | Carroll | 2/148 |
| 4,143,422 | 3/1979 | Wilson | 2/145 |
| 4,610,037 | 9/1986 | Haymer | 2/145 |
| 5,253,366 | 10/1993 | Marlo et al. | 2/145 |

*Primary Examiner*—Jeanette E. Chapman
*Attorney, Agent, or Firm*—Waddey & Patterson; Edward D. Lanquist, Jr.

[57] ABSTRACT

The present invention discloses a bolo having a string like portion and a gripping portion. The string like portion has a first and second end. The bolo portion is attached to a tie-like or blade portion having an upper side and lower side, a face and a rear, and a first hole and second hole. In the gripping portion of the bolo is received by the first hole. The bolo is then placed through the gripping portion. The ends of the string like portion then pass through the second hole from the rear to the front thereby exposing the first end and the second end and anything attached to them.

9 Claims, 4 Drawing Sheets

DEVICE FOR WEARING AROUND THE NECK OF A USER

BACKGROUND OF THE INVENTION

The present invention relates generally to decorative clothing and more particularly to a tie.

It will be appreciated by those skilled in the art that individuals like to wear neckwear. This neckwear includes scarves, ties, bolos, and the like. In country western circles, one of the most common types of neckwear is the bolo which consists of a string like portion and gripping portion. The string like portion is worn around the user's neck then fed through the gripping portion with the ends of the string like portion being exposed at the bottom. To be taken off, the griping portion needs merely to be advanced toward the end toward the first and second ends of the bolo and then can be slipped off thereby allowing the bolo to be removed over the user's head without having to disassociate the string like portion from the gripping portion. It will further be appreciated by those skilled in the art that many people do not like to wear ties because of the large amount of material placed around the user's neck. Some people have attempted to use clip-on ties which only, over time, separate from the user's collar.

What is needed, then, is a device which combines the ornamental and mechanical features of the bolo with the look of a tie. This needed device must also combine the ornamental features of the bolo ends thereby exposing them for view. Further, this device must be capable of exposing the gripping device of the bolo thereby further improving the ornamental and useful features of the tie. This tie is presently lacking in the prior art.

SUMMARY OF THE INVENTION

The present invention discloses a bolo having a string like portion and a gripping portion. The string like portion has a first and second end. The bolo portion is attached to a tie-like or blade portion having an upper side and lower side, a face and a rear, and a first hole and second hole. In the gripping portion of the bolo is received by the first hole. The bolo is then placed through the gripping portion. The ends of the string like portion then pass through the second hole from the rear to the front thereby exposing the first end and the second end and anything attached to them.

Accordingly, one object of the present invention is to provide a tie.

A still further object of the present invention is to combine the mechanical and ornamental features of a bolo and a regular tie.

A still further object of the present invention is to provide a tie which has some of the aspects of a bolo and some of the aspects of a standard tie.

A still further object of the present invention is to provide a device which provides improved attachment to a clip-on tie.

A still further object of the present invention is to provide a device which simulates the thickness of a knot.

DESCRIPTION OF THE PREFERRED EMBODIMENT

Figure 1:
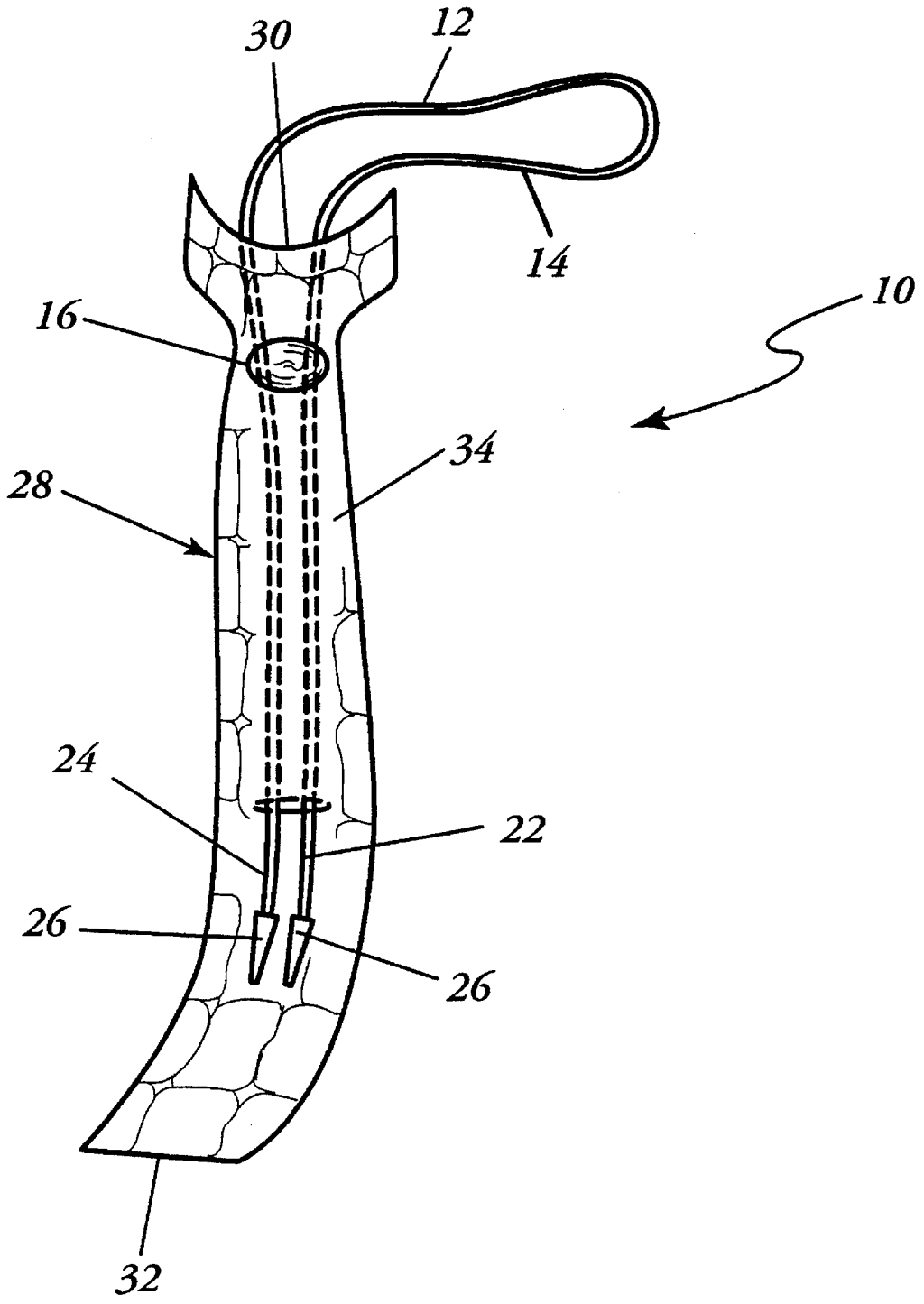
FIG. 1 is a perspective view of the device of the present invention.
Figure 2:
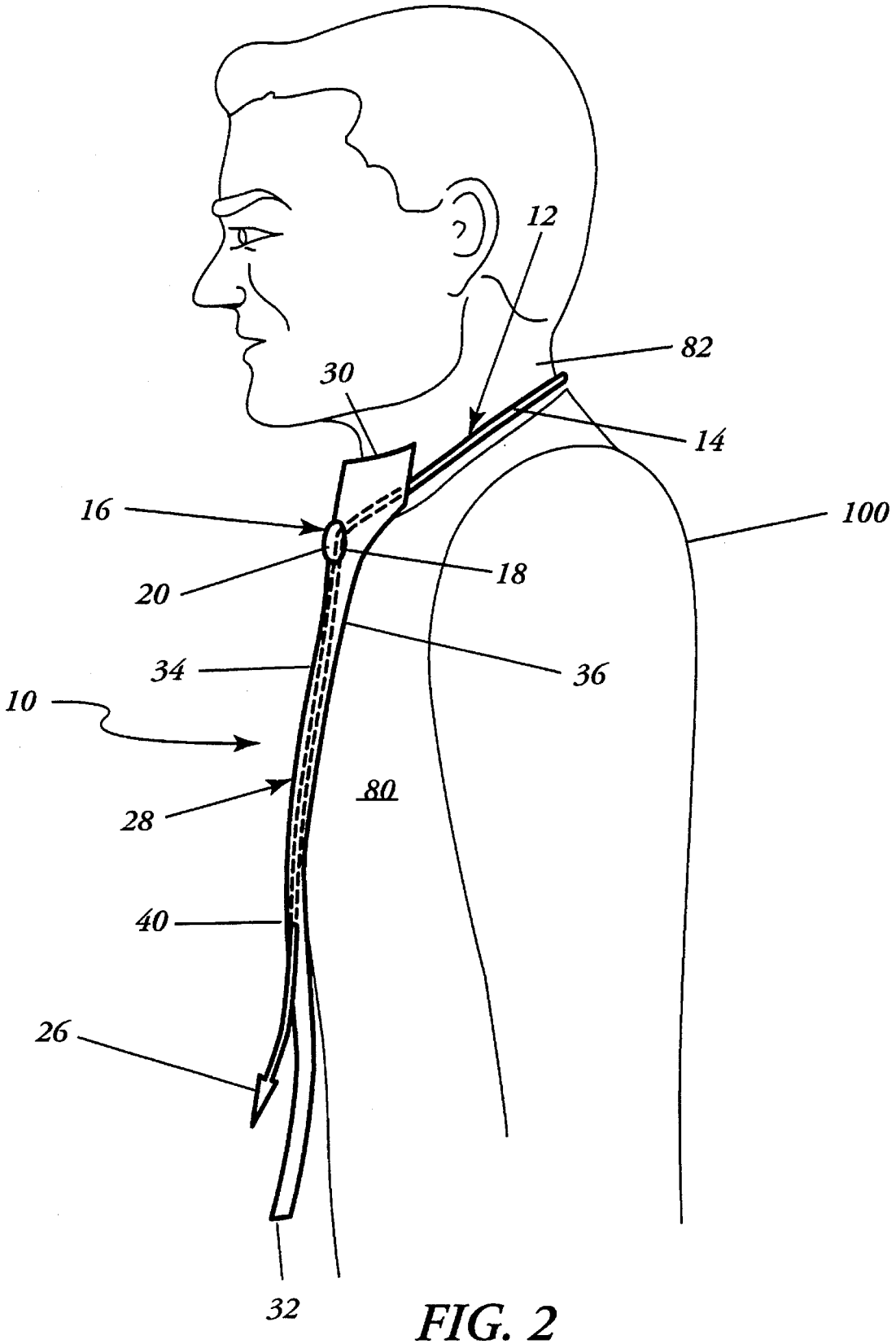
FIG. 2 is a side view of the device of the present invention as worn on a user.

Referring now to FIGS. 1 and 2 there is shown generally at 10 the device for wearing around the neck of a user 100 having a chest. Device 10 is made of bolo 12 having string like portion 14 and gripping section or portion 16. String like section 14 has first end 22 and second end 24. Attached to first and second ends 22, 24 are points 26. As shown in FIGS. 1 and 2, device 10 also comprises tie-like or blade portion or section 28 which has upper end 30, lower end 32, face 34, rear 36, first hole 38, and second hole 40. In the preferred embodiment, first hole 38 is placed proximate upper section 30 while second hole 40 is placed proximate lower section 32. In the preferred embodiment, gripping section 16 having front 20 and openings 18 receive first end 22 and second end 24 of string like portion 14 after gripping section 16 is placed into and received by first hole 38. This allows front 20 of griping section 16 to be exposed. String like section 14 then passes along rear 36 of tie from first hole 38 to second hole 40 where first end 22 and second end 24 pass through second hole 40 from rear 36 to face 34. This exposes ends 22, 24 and points 26 attach to each of first end 22 and second end 24. In the preferred embodiment, tie-like section or blade portion 28 lies along chest 80 of user 100 while string like portion 34 encircles neck 82 of user 100. This design allows face 34 to contain any ornamental feature. This further allows an ornamental feature to be placed on gripping section 16 in the preferred embodiment.

Figure 3:
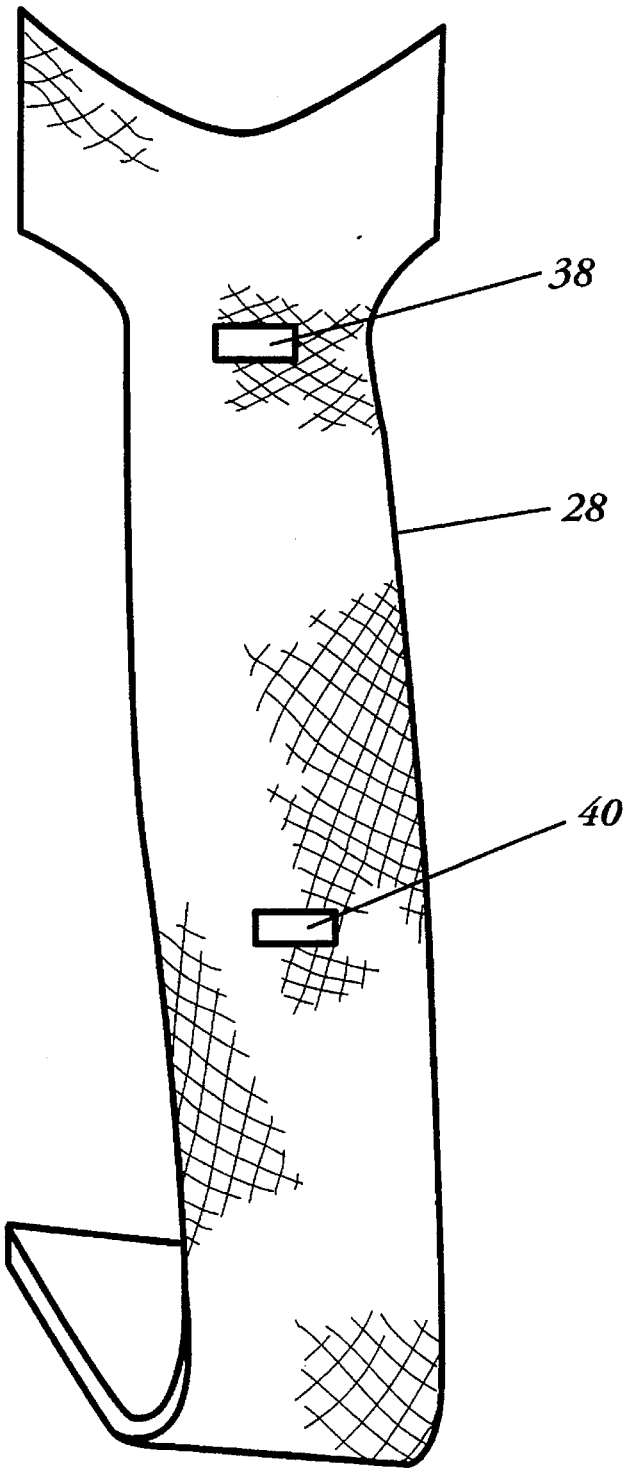
FIG. 3 is a frontal view of the blade portion of the device of the present invention.

Referring now to FIG. 3 one can see tie-like or blade portion 28 of the present invention. As can be seen and has been discussed before, portion 28 has first hole 38 and second hole 40.

Figure 4:
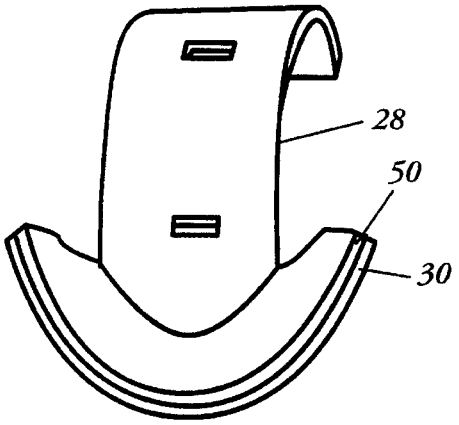
FIG. 4 is a plan view of the device of the present invention showing the knot simulator.
Figure 5:
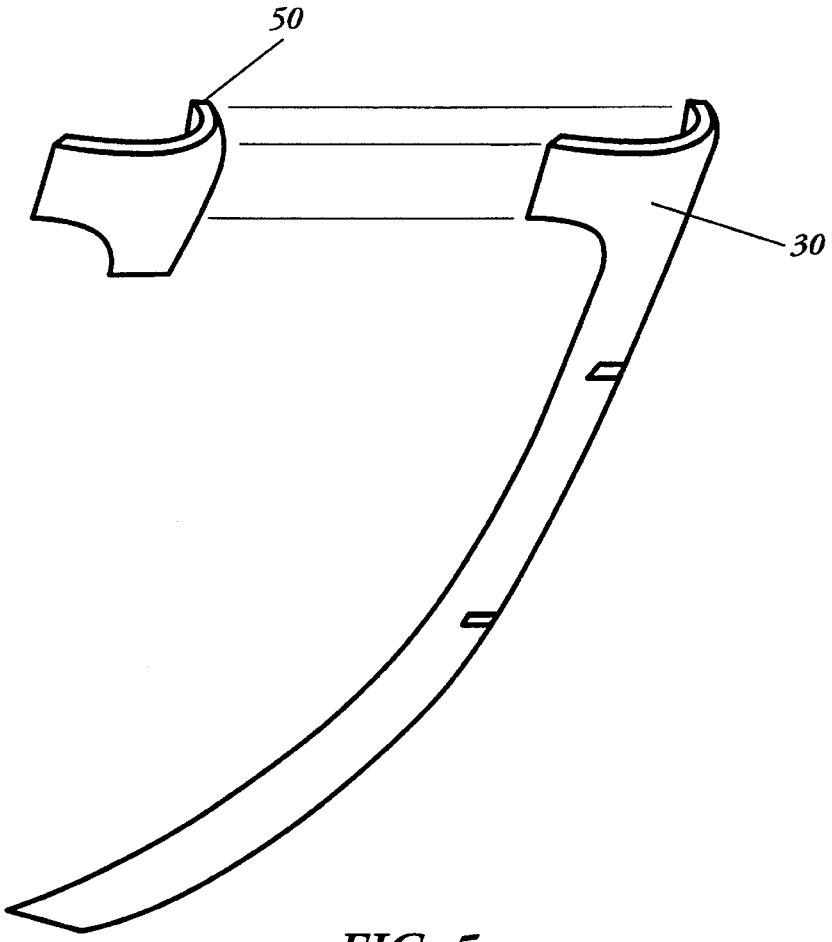
FIG. 5 is an exploded view showing the blade portion of the device of the present invention along with the knot simulator.

Referring now to FIG. 4, in addition to upper end 30 of portion 28 there is placed knot simulator 50 which allows upper portion 30 to simulate the thickness of a knot. In greater detail, referring to FIG. 5, one can see knot simulator 50 exploded from upper section 30. Upper section 30 and knot simulator 50 are attached in any way but are, in the preferred embodiment, releasably attached together using Velcro®, snaps, and the like.

Thus, although there have been described particular embodiments of the present invention of a new and useful device for wearing around the neck of a user, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for wearing by a user having a neck and a chest comprising:

a. an elongated string having a first end and a second end for wearing around said neck; and b. an elongated blade portion resembling a necktie blade having an upper end for placement proximal said neck of said user and a lower end, said blade further having a first hole and a second hole and a face and a rear, said string is attached to said blade proximate said first hole and said first end and said second end pass through said second hole from said rear to said face to be exposed proximate said lower end.

2. The device of claim 1 wherein said blade rests proximal chest when said string is worn around said neck.

3. The device of claim 1 further comprising a gripping device receiving said string proximal said first hole.

4. The device of claim 1 further comprising a knot simulator attached to said blade proximal said upper end.

5. A tie comprising:

a. a bolo having a string received by a gripping portion; and b. an elongated blade portion resembling a necktie having an upper end and a lower end, a face and a rear, and a first hole and a second hole wherein said second hole receives said string and said bolo attaches to said blade proximal said first hole.

6. The device of claim 5 wherein said string passes through said second hole from said rear to said face.

7. The device of claim 5 wherein said gripping portion lies proximate said first hole and receives said bolo.

8. The device of claim 5 further comprising a knot simulator attached to said blade proximal said upper end.

9. A tie for wearing by a user having a neck and a chest comprising:

a. a bolo having a string and a gripping section, said string having a first end and a second end;

b. an elongated blade portion resembling a necktie having an upper end and a lower end, a face and a rear, and a first hole and a second hole wherein said first end and said second end attach to said blade proximal said first hole and said second end passes through said second hole from said rear to said face;

c. a knot simulator attached to said blade proximal said upper end; and d. a pair of points each attached to one of said first end or said second end.

* * * * *